United States Patent [19]

Niggemann

[11] Patent Number: 4,944,163

[45] Date of Patent: Jul. 31, 1990

[54] FLOW CONTROL APPARATUS AND METHOD

[75] Inventor: Richard E. Niggemann, Rockford, Ill.

[73] Assignee: Sundstrand Corporation, Rockford, Ill.

[21] Appl. No.: 336,595

[22] Filed: Apr. 10, 1989

Related U.S. Application Data

[63] Continuation of Ser. No. 129,449, Dec. 7, 1987, abandoned.

[51] Int. Cl.[5] ..... F25B 1/06

[52] U.S. Cl. ..... 62/500; 62/191

[58] Field of Search ..... 62/500, 304, 100, 268

[56] References Cited

U.S. PATENT DOCUMENTS

| | | | |
|---|---|---|---|
| 3,134,241 | 5/1964 | Johnson | 62/196.1 |
| 3,282,227 | 11/1966 | Nielsen | 103/263 |
| 3,473,481 | 10/1969 | Brane | 103/271 |
| 3,608,824 | 9/1971 | Ballou | 239/124 |
| 3,701,264 | 11/1972 | Newton | 62/500 X |
| 3,787,006 | 1/1974 | Coanda | 243/6 |

*Primary Examiner*—Henry Bennett

*Attorney, Agent, or Firm*—Wood, Phillips, Mason Recktenwald & Vansanten

[57] ABSTRACT

An apparatus for flow control of a fluid in a two-phase thermal management system including an evaporator connected in series following a cavitating venturi. The vapor pressure of a vaporous cavitation bubble formed in the venturi upon passage of a fluid therethrough is regulated to the pressure of the wet vapor exhaust from the evaporator by joining the wet vapor exhaust of the evaporator to the cavitation bubble of the venturi.

4 Claims, 3 Drawing Sheets

FIG. 1
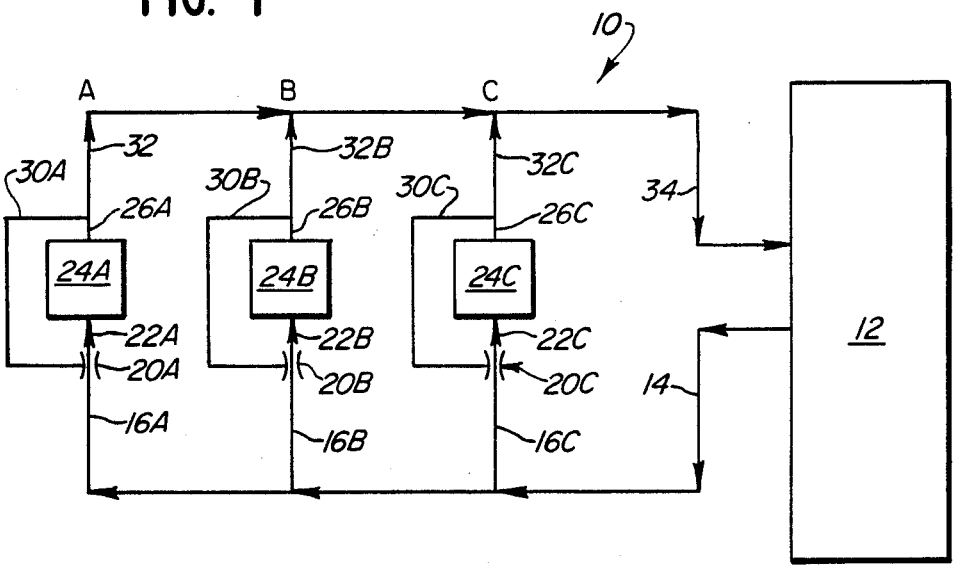
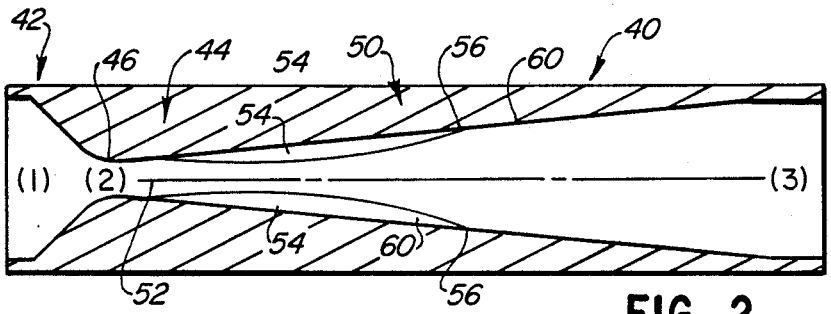
FIG. 2
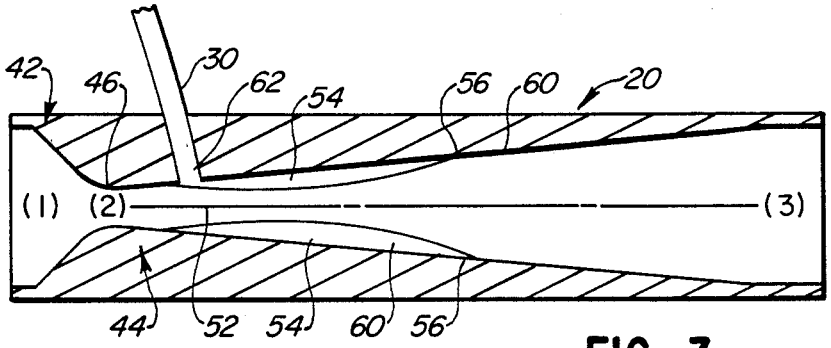
FIG. 3

FIG. 4A
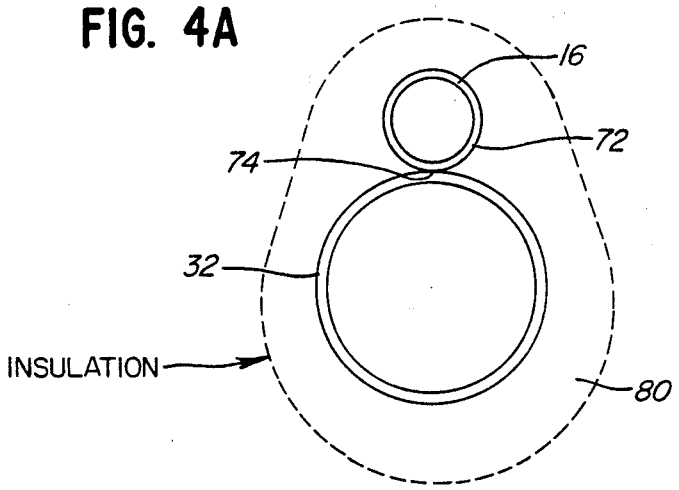
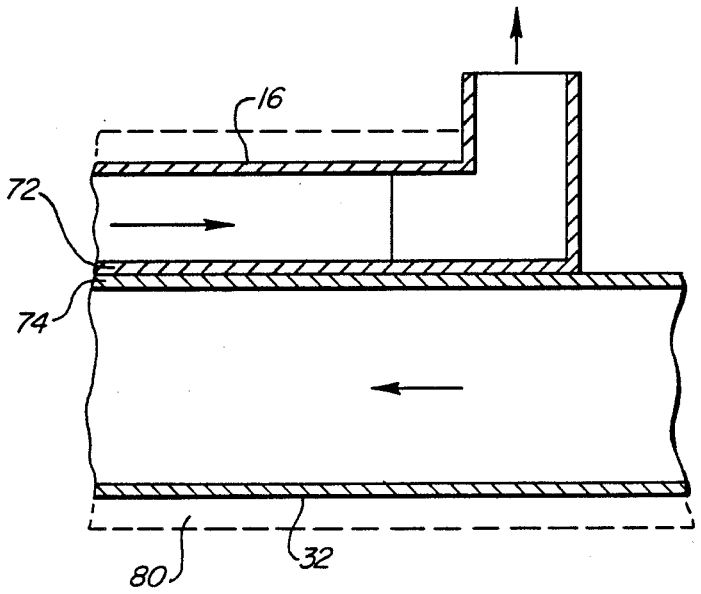
FIG. 4B

FIG. 5A
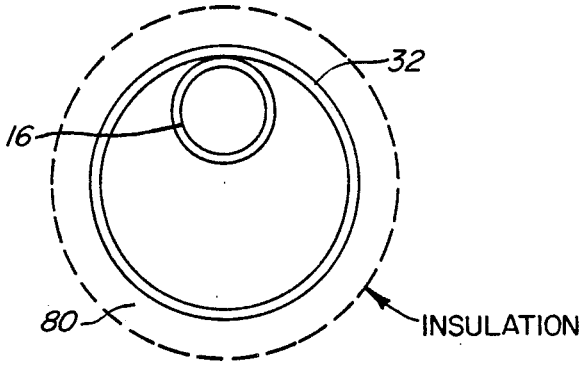
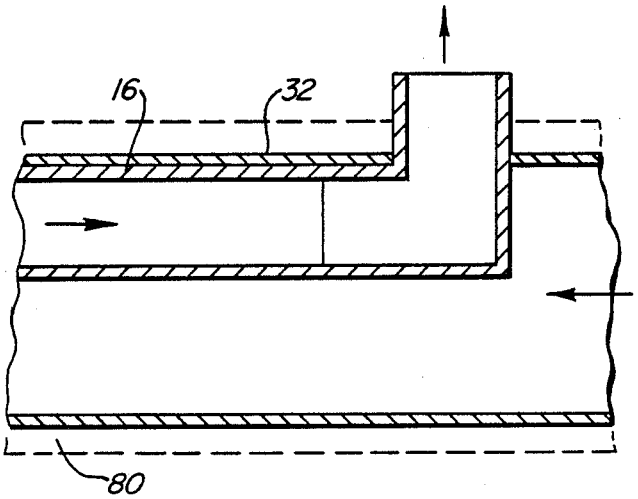
FIG. 5B

FLOW CONTROL APPARATUS AND METHOD

This application is a continuation of application Ser. No. 129,449 filed Dec. 7, 1987, now abandoned.

FIELD OF THE INVENTION

This invention generally relates to flow control systems and, particularly, to devices and methods useful for fluid flow control in two-phase thermal management systems.

BACKGROUND OF THE INVENTION

Many different types of fluid flow measuring devices are used commercially. A common type of flow measuring device is a head meter which operates by relating the pressure drop through a flow restriction to either the point velocity (pivot tube) or average velocity (orifice, venturi) via a mechanical energy balance.

With a cavitating venturi, the flow therethrough is proportional to the square root of the difference between the inlet pressure to the device and the fluid saturation pressure. Thus, for systems which provide a constant value for this pressure difference, the use of a cavitating venturi will result in a precise measurement and control of the flow rate. However, if heat losses occur in the system, such as through the plumbing of the system, the saturation pressure rather than remaining constant will decrease over time, resulting in a higher value for the relevant pressure difference. This in turn will result in the device measuring a higher flow rate therethrough.

Such a result is very undesirable in systems such as two-phase thermal management systems which have one or more evaporators connected in parallel and controlled by cavitating venturis. Substantial heat losses in such a system will result in increased flow rates which in turn assembly will change the pressure delivered by the flow control assembly and generally upset the flow control in all parallel branches.

A varying value for the difference between the inlet pressure to the device and the fluid saturation pressure, as realized by systems wherein heat loss occurs, significantly increases the difficulty of using cavitating venturi devices for flow measurement and control systems.

SUMMARY OF THE INVENTION

An object, therefore, of the invention is to provide a new and improved apparatus useful for flow control of a fluid such as in a nearly isobaric two-phase thermal management system.

The apparatus includes a venturi having an inlet section, a constricted section including a throat and a diffusion section. Upon passage of a fluid through the venturi, a vaporous cavitation bubble is formed therein downstream of the throat along the interior walls of the diffusion section. The apparatus generally includes means for controlling the pressure drop realized across the throat of the venturi.

Specifically, a conduit or line communicates through the venturi walls to the cavitation bubble. Connection of this conduit in series after an evaporator having a nearly isobaric wet vapor exhaust outlet provides the means for controlling the pressure drop realized across the throat. If the liquid supplied to the venturi is subcooled only slightly, a very small amount of vapor may flow through this conduit from the cavitation bubble to the evaporator outlet. If the liquid is subcooled a substantial amount, then wet vapor from the evaporator outlet will flow into the cavitation bubble attempting to maintain it at a pressure close to evaporator outlet pressure Other objects, features and advantages of the invention will be apparent from the following detailed description taken in conjunction with the accompanying drawings.

BRIEF DESCRIPTION OF THE DRAWINGS

The features of this invention which are believed to be novel are set forth with particularity in the appended claims. The invention, together with the objects and advantages thereof, may be best understood by reference to the following description taken in conjunction with the accompanying drawings, in which like reference numerals identify like elements in the figures and in which:

FIG. 1 is a partial schematic illustration of a nearly isobaric two-phase thermal management system incorporating the flow control apparatus of the invention;

FIG. 2 is an axial section through a conventional venturi in operation while cavitating;

FIG. 3 is an axial section through a flow control apparatus including a venturi according to the invention, in operation while cavitating;

FIGS. 4*a* and 4*b* are end and side cross-sectional views, respectively, of a liquid supply line and a two-phase vapor return line according to a typical embodiment of the invention; and FIGS. 5*a* and 5*b* are end and side cross-sectional views, respectively, of a liquid supply line and a two-phase vapor return line according to an alternative embodiment of the invention.

DETAILED DESCRIPTION OF THE PREFERRED EMBODIMENT

Referring to the drawings in greater detail, and first to FIG. 1, relevant portions of a nearly isobaric two-phase thermal management system, generally designated 10, are shown to include a rotary fluid management device 12.

A subcooled liquid flow stream 14 exits the rotary fluid management device 12 and is subsequently branched in parallel to form evaporator feed lines 16. In FIG. 1, the branches as well as the components of each branch have been individually identified as A, B and C but, in order to facilitate discussion of the figure, reference to the components will be made by referring to the component's reference numeral without reference to particular branch identifications, i.e., A, B or C.

Each of the feed lines 16 pass through a cavitating venturi 20. Flow lines 22, exiting the cavitating venturis 20, are fed directly into evaporators 24. A wet vapor return stream 26 exits each of the evaporators 24. The wet vapor streams 26 are joined to the cavitating venturis 20 by means of bypass lines 30 which connect the exhaust pressure of each of the evaporators to the cavitating venturis 20 in the vapor cavitation bubble downstream of the accelerating nozzle throat of the venturi, more particularly discussed with reference to FIG. 3. The wet vapor return line 32 of each of the evaporators 24 are joined together to form a wet vapor return line 34 which feeds to the rotary fluid management device 12 wherein the vapor pressure of the wet vapor return line 34 is regulated to a narrow range. In such a fashion, the venturis can be operated at virtually constant flow independent of inlet liquid temperature loss.

FIG. 2 shows a normal cavitating venturi 40 operating in the cavitating mode. The venturi 40 includes an inlet section 42, a constricted section 44 including a throat 46 and a diffusion section 50. In operation in a cavitating mode, fluid 52 passing through throat 46 of the venturi 40 accelerates through the throat and diffuses out in diffusion section 50, forming a cavitation bubble 54 between throat 46 and a point 56 where the fluid reattaches to walls 60 of the venturi.

FIG. 3 shows a venturi 20 according to the invention. In the venturi 20 shown in FIG. 3, a bypass conduit or line 30 is shown connecting with the venturi 20 at a point 62 downstream of throat 46 and preceding the point 56 at which fluid 52 attaches to the venturi wall 60, i.e. in the vapor cavitation bubble 54 downstream of the accelerating nozzle throat. Connection of conduit 30 in series after an evaporator having a nearly isobaric wet vapor exhaust outlet provides the means for controlling the pressure drop across the throat.

As shown in FIG. 1, the line 30 may serve as a bypass line around an evaporator connecting the evaporator exhaust pressure to the cavitating venturi at the vapor cavitation bubble. In this fashion wherein the wet vapor return line has its pressure regulated to a narrow range and the controlled wet vapor return line pressure is connected to the vapor space of the cavitation bubble of the cavitating venturi, the desired pressure drop is imposed across the accelerating nozzle. Thus, the flow rate through the cavitating venturi can be made independent of liquid feed line temperature loss. If the liquid supplied to the venturi is subcooled only slightly, as in the system disclosed herein, a very small amount of vapor may flow through this conduit from the cavitation bubble to the evaporator outlet. If the liquid is subcooled a substantial amount, then wet vapor from the evaporator outlet will flow into the cavitation bubble attempting to maintain it at a pressure close to evaporator outlet pressure.

It is known to use ammonia and refrigerant Freon R114 as working fluids in such two-phase thermal management systems. The vapor pressure of such working fluids is quite sensitive to temperature, e.g., ammonia has a vapor pressure which changes approximately 2.2 psi per degree Fahrenheit change. Thus, a ten degree Fahrenheit temperature loss increases the driving potential for accelerating the flow through the nozzle by 22 psi. The apparatus and method of the invention, however, will allow operation of virtually constant flow independent of inlet liquid temperature losses.

In a preferred embodiment, the liquid feed lines would be thermally conditioned so as to minimize the heat lost by the system. FIGS. 4A–4B, and 5A–5B illustrate alternative methods by which the liquid feed lines may be thermally conditioned.

In FIGS. 4A and 4B, the temperature controlled liquid line 16 and the two-phase vapor line 32 from the evaporator (not shown) are adjacent one another with a wall 72 of the liquid line 16 in contact with a wall 74 of the two-phase vapor line 32. In addition, the lines 16 and 32 share the same insulation system 80 with the flow of liquid in line 16 to the venturi being countercurrent to the flow of two-phase vapor in line 32 from the evaporator.

In FIGS. 5A and 5B, the liquid supply line 16 is shown as being contained within the two-phase vapor line 32 from the evaporator (not shown). Again, the lines 16 and 32 share the same insulation system 80 with the flow of liquid in line 16 to the venturi being countercurrent the flow of two-phase vapor in line 32 from the evaporator.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

I claim:

1. A method of operating a cavitating venturi for fluid flow control in a thermal management system having an evaporator with a wet vapor exhaust, the venturi having an inlet section, a constricted section including a throat, and a diffusion section comprising regulating the pressure of a vaporous cavitation bubble downstream of the venturi throat to the pressure of said wet vapor exhaust of said evaporator.

2. The method of claim 5 including communicating said wet vapor exhaust with the vapor of said cavitation bubble.

3. An apparatus for flow control of a fluid in a thermal management system having an evaporator with a wet vapor exhaust, comprising:

a cavitating venturi having an inlet section, a constricted section including a throat, and a diffusion section, said venturi having means for forming a vaporous cavitation bubble downstream of the throat upon passage of a fluid therethrough; and means communicating the vapor of said cavitation bubble with said wet vapor exhaust for controlling the pressure drop realized across said throat of said venturi.

4. The apparatus of claim 3 wherein said bypass means include a conduit line through wall means of the venturi in communication with the cavitation bubble.

* * * * *